US009956443B1

(12) United States Patent
Cutting

(10) Patent No.: US 9,956,443 B1
(45) Date of Patent: May 1, 2018

(54) ATTIC SPRINKLER SYSTEMS

(71) Applicant: Tyco Fire Products LP, Lansdale, PA (US)

(72) Inventor: Sean E. Cutting, West Warwick, RI (US)

(73) Assignee: Tyco Fire Products LP, Lansdale, PA (US)

( * ) Notice: Subject to any disclaimer, the term of this patent is extended or adjusted under 35 U.S.C. 154(b) by 236 days.

(21) Appl. No.: 14/931,640

(22) Filed: Nov. 3, 2015

Related U.S. Application Data

(60) Provisional application No. 62/074,503, filed on Nov. 3, 2014.

(51) Int. Cl.
*A62C 3/00* (2006.01)
*A62C 35/68* (2006.01)
*A62C 37/40* (2006.01)

(52) U.S. Cl.
CPC ..... *A62C 3/00* (2013.01); *A62C 35/68* (2013.01); *A62C 37/40* (2013.01)

(58) Field of Classification Search
CPC ..... A62C 3/00; A62C 35/68; A62C 37/40; A62C 99/0009; A62C 35/00; A62C 35/58; A62C 35/60; A62C 35/62; A62C 35/64; A62C 35/605; A62C 37/00; Y10S 239/15
USPC ..... 169/46, 5, 16, 17
See application file for complete search history.

(56) References Cited

U.S. PATENT DOCUMENTS 3,180,422 A * 4/1965 Kelley ..... A62C 35/605 169/23
3,811,511 A 5/1974 McCulloch
3,834,463 A 9/1974 Allard et al.
4,217,959 A 8/1980 Poulsen
4,984,637 A 1/1991 Finnigan
6,814,150 B2 * 11/2004 Clauss ..... A62C 31/02 169/37
8,083,002 B1 * 12/2011 Golinveaux ..... A62C 35/60 169/16
8,307,906 B2 * 11/2012 Reilly ..... A62C 35/64 169/16
8,800,673 B2 8/2014 Multer et al.
(Continued)

FOREIGN PATENT DOCUMENTS

EP 2402919 1/2012

OTHER PUBLICATIONS

National Fire Protection Association NFPA 13: Standard for the Installation of Sprinkler Systems, p. 13-56 (2013 ed.), 1 page.
(Continued)

*Primary Examiner* — Justin Jonaitis
(74) *Attorney, Agent, or Firm* — Perkins Coie LLP

(57) ABSTRACT

Systems and methods for the protection of an attic or concealed combustible space defined by a ceiling base and a roof deck disposed above a ceiling base defining a peak are provided. A plurality of fluid distribution devices are spaced above the ceiling base and below the roof deck to define a peak region. At least one fire detection assembly is disposed in the peak region above the fluid distribution devices to detect a fire in the attic space. A controller couples the plurality of distribution devices to the fire detection assembly. The fluid distribution devices are disposed at a working clearance distance above the ceiling base to provide an extended protected eaves region of the attic space.

20 Claims, 6 Drawing Sheets

(56) References Cited

U.S. PATENT DOCUMENTS

| | | | | |
|---|---|---|---|---|
| 2005/0072580 | A1* | 4/2005 | Jackson | A62C 3/004 169/16 |
| 2007/0114046 | A1* | 5/2007 | Munroe | A62C 5/02 169/16 |
| 2007/0221388 | A1* | 9/2007 | Johnson | A62C 35/58 169/16 |
| 2014/0174768 | A1* | 6/2014 | Bucher | A62C 37/11 169/46 |
| 2017/0216641 | A1* | 8/2017 | Magnone | A62C 35/60 |

OTHER PUBLICATIONS

Leviton, Technical Bulletin: PIR and US Sensor Technology (Mar. 17, 2010), 5 pages.
"Fire Detection With A Combined Ultrasonic-Microwave Doppler Sensor," (Oct. 1998), 4 pages.
Tyco Fire Products LP Publication, "Application: The Use of Specific Application Spinklers for Protecting Attics" (2007), 91 pages.
Tyco Fire Protection Products publication, TFP1346, "Series MJC Multiple Jet Controls DN20, DN25, DN40 and DN50, 12 bar BSPT Inlet & Outlet Threads." (May 2013), 12 pages.
Data Sheet for 2/2 Series 8210 Pilot Operated General Service Solenoid Valves from ASCO®, 2 pages.
"Design of Long Life Servo Valves Moog's Approach to Design, Manufacture, and Construction of Feedback Mechanisms," Dan Baran, 6 pages (2012).
U.S. Appl. No. 62/074,503, filed Nov. 3, 2014, 204 pages.

* cited by examiner

ATTIC SPRINKLER SYSTEMS

PRIORITY DATA & INCORPORATION BY REFERENCE

This application claims the benefit of priority to U.S. Provisional Application No. 62/074,503, filed Nov. 3, 2014, which application is incorporated by reference in its entirety.

TECHNICAL FIELD

The present invention relates generally to fire protection systems and more specifically to fire protection systems for the protection of attic spaces.

BACKGROUND ART

Generally, an attic space can be defined as the space between a horizontal ceiling base and a roof deck above the ceiling base which angles or slopes and rises to a peak. Disposed laterally of the peak is an eaves region of the attic space, which is more generally a triangular section of the attic space proximate the eaves corner or intersection of the roof deck and the ceiling base. In order to provide fire protection for these lateral eaves regions of the attic space, it is known to use automatic fire protection sprinklers positioned medially between the intersection of the roof deck and ceiling base and the peak. In the fire protection industry standard, National Fire Protection Association NFPA 13*: Standard for the Installation of Sprinkler Systems* (2013 ed.), "automatic sprinklers" are defined as "a fire suppression or control device that operates automatically when its heat-activated element, such as for example, a bulb or soldered link and lever trigger assembly, is heated to its thermal rating or above, allowing water to discharge over a specified area." Accordingly for these known systems, the functions of fire detection and distribution of the firefighting fluid are physically located at the same site as the automatic sprinkler.

Installation of automatic sprinklers for protecting the eaves regions can present installation constraints or problems because the automatic sprinkler must be installed sufficiently close to the eaves region to thermally respond to a fire therein, yet be sufficiently spaced proximate the eaves region to effectively distribute the firefighting fluid for addressing the fire. Under the fire protection industry standard, National Fire Protection Association NFPA 13*: Standard for the Installation of Sprinkler Systems* (2013 ed.), criteria is specified for the installation of fire protection sprinkler systems for attic spaces. The installation criteria can include sprinkler spacing and location requirements and application density requirements for sprinklers in order to protect attic spaces with peaked or sloped roofs including protection of the eaves region, the eaves corner and the areas along the base.

FIG. 8.6.4.1.4 of Section 8.6.4.1.3 of NFPA 13 schematically shows sprinklers below a roof deck in an attic space. For the purpose of fire protection of the eaves regions, the protected eaves region is defined by the intersection of the roof and ceiling joists and the distance to the first sprinkler disposed medially of the intersection. The location of this first medial sprinkler relative to the intersection defines a vertical distance to the ceiling deck and a horizontal distance to the intersection along the ceiling deck. Section 8.6.4.1.4.3 of NFPA 13 specifies, for a roof slope of 4 in 12 or greater, a minimum distance in the direction of slope to the intersection for locating the medially disposed automatic sprinkler in order for the sprinkler to properly operate for eaves protection in the attic space. According to Section 8.6.4.1.4.3, the first medial automatic sprinkler is not to be less than five feet (5 ft.) from the intersection of the roof and ceiling joists in the direction of slope. The installation requirements can require that automatic sprinklers be installed and spaced in order to provide, for example, a 0.1 gallon per minute per square foot (0.1 gpm/sq. ft.) fluid distribution density requirement. Accordingly, for known systems using automatic sprinklers, it is believed that the installed vertical distance of the automatic sprinkler to the ceiling base is a function of the 0.1 gpm/sq. ft. density requirement and the five foot (5 ft.) minimum distance in the direction of roof slope.

For known attic fire protection systems, the vertical distance of the sprinkler to the ceiling base presents a limit or design constraint in order to meet the operative and installation requirements of current systems using automatic sprinklers. The vertical limitation on installing automatic sprinklers for protection of the eaves regions can be problematic because it may require installing sprinklers in low clearance areas below the roof or areas with unforeseen obstructions which can make system installation difficult due to the limited heights and areas in which people can operate or fire protection or other equipment can be installed. For example, it is believed that, in order to meet the 5 ft. minimum distance and the 0.1 gpm/sq. ft. density requirements, a medially disposed automatic sprinkler in known systems for eaves protection is to be located at a maximum vertical distance from the ceiling deck ranging from about 29 inches to less than two feet down to about 19 inches. Moreover, the low clearance areas and/or obstructions therein can define unexpected fire growth patterns to complicate the limited thermal responsiveness and fluid distribution patterns of automatic sprinklers. Thus, for current systems using automatic sprinklers in which the thermal response and fluid distribution functions of the system are coupled at the location of the sprinkler, the region or range of eaves protection is constrained by the vertical distance of automatic sprinklers to the ceiling base.

DISCLOSURE OF INVENTION

Preferred systems and methods are provided for attic space fire protection with expanded ranges or regions of eaves fire protection in which firefighting fluid distribution devices for the protection of eaves regions can be installed in convenient and accessible regions of the attic space. To expand the region of eaves protection and the vertical distance from the ceiling base at which the fluid distribution devices are installed, the preferred systems separately or independently locate the function of fire detection and fluid distribution. The preferred systems and methods preferably provide for attic space fire protection in which firefighting agent is discharged and distributed by fluid distribution devices controlled, operated and/or initiated by separately spaced fire detection assemblies. The fluid distribution devices are located within the attic space to define a peak region and the fire detection assemblies are located within the peak region spaced above the fluid distribution devices. Moreover, the preferred systems and methods provide for expanded or extended protected eaves regions that are larger than those protected under previously known commercial systems.

Generally, the attic space is defined by a ceiling base and a roof deck disposed above a ceiling base, the roof deck being sloped with respect to the ceiling base to define a peak and further define an intersection of the roof deck and the ceiling base laterally of the peak. The preferred systems include a first or initial group of fluid distribution devices disposed medially of the intersection of the roof deck and ceiling base, between the intersection and the peak, to define a protected eaves region and more preferably an expanded or extended protected eaves region with a working clearance distance beneath the fluid distribution device. In a preferred aspect, the working clearance distance is preferably unconstrained and overcomes the problems of the prior art and more particularly provides for a working clearance distance of thirty inches or greater.

Operation or discharge of the firefighting fluid from the fluid distribution devices is controlled in response to a fire detection assembly located in the peak region of the attic space and more preferably located proximate the peak. Preferred fluid distribution devices include electrically actuated fire protection sprinklers, or alternatively, the fluid distribution devices can include electrically operated mist devices, fire grenades or aerosol distribution devices. Alternatively, the fluid distribution devices can be normally open sprinklers coupled to an electrically actuated fluid control device or valve. Preferred fire detection assemblies can include passive sensors or elements such as, for example, any one of infrared sensors, ultrasonic sensors, microwave sensors or a combination thereof. Preferred electronic detection and control using individually addressable components can provide for selective operation of one or a group of fluid distribution devices to protect one or more areas or regions of the attic space. The preferred systems can be configured as a wet system or alternatively can be configured as a dry system or a deluge system.

One preferred embodiment of a fire protection system for the protection of an attic space includes a plurality of fluid distribution devices disposed in the attic space to define a peak region; and at least one fire detection assembly disposed in the peak region spaced above the plurality of fluid distribution devices. A preferred method of attic space fire protection is also provided that includes unconstrained, expanded and/or extended eaves fire protection with separately located fire detection and fluid distribution functions. A preferred method includes locating a plurality of fluid distribution devices below the peak of the attic space to define a peak region and a protected eaves region; and locating a fire detection assembly in the peak region spaced from the plurality of fluid distribution devices. Another preferred embodiment of an attic space fire protection system includes at least one fluid distribution device defining an extended protected eaves region; and a fire detection assembly in a peak region of the attic associated with the at least one fluid distribution device.

BRIEF DESCRIPTION OF DRAWINGS

The accompanying drawings, which are incorporated herein and constitute part of this specification, illustrate exemplary embodiments of the invention and, together with the general description given above and the detailed description given below, serve to explain the features of the invention. It should be understood that the preferred embodiments are some examples of the invention as provided by the appended claims.

MODE(S) FOR CARRYING OUT THE INVENTION

Figure 1A:
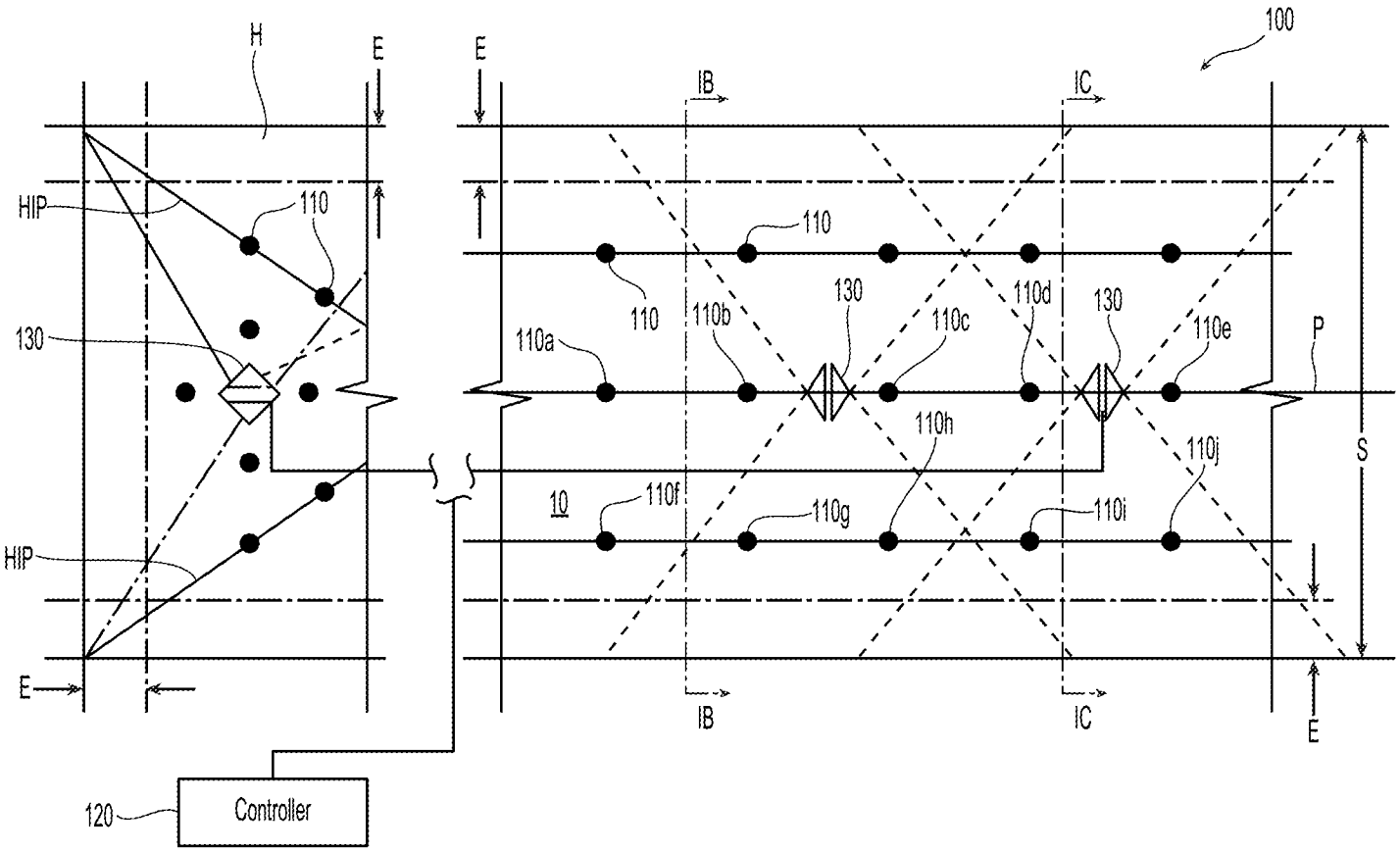
FIG. 1A shows a plan schematic view of a preferred controlled wet system.
Figure 1B:
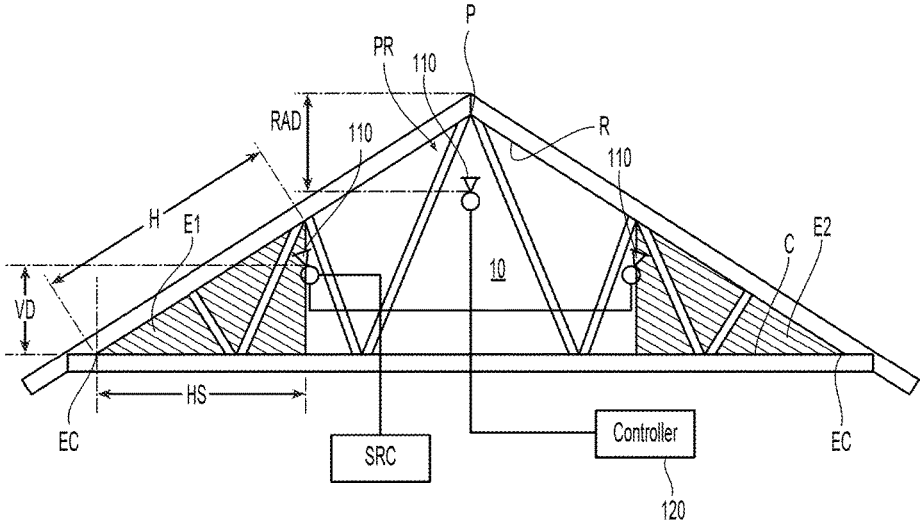
FIG. 1B shows a schematic elevation view of the system of FIG. 1A along line IB-IB.
Figure 1C:
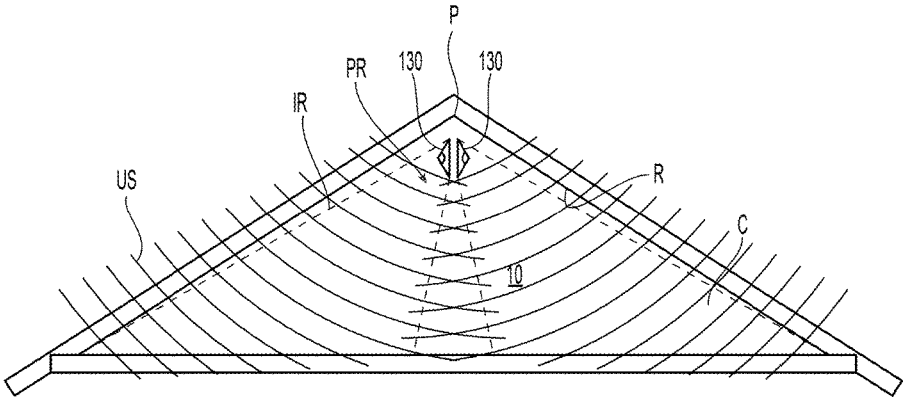
FIG. 1C shows a schematic view of the system of FIG. 1A along line IC-IC.

Shown in FIGS. 1A-1C is a preferred embodiment of a fire protection system 100 for the protection of a combustible concealed space beneath a roof deck R and a ceiling base C and more preferably a fire protection system for the protection of an attic space 10 with controlled actuation or operation of and/or discharge from one or more fluid distribution devices 110 for distribution of a firefighting fluid or agent. With reference to FIG. 1B, the roof deck R is preferably sloped with respect to the ceiling base C to define a slope (rise:run) of 4:12 or greater and a peak P. An exemplary attic space 10 is further defined by a span S of the horizontally extending ceiling base C and an outer eaves region E. The roof deck R can further include a hip region HIP, that includes the eaves region E. In the elevation view of the attic space 10 in FIG. 1B, the outer eaves region E to be protected can include a first eaves region E1 and second eaves region E2 disposed laterally and preferably laterally about the peak P. Each of the protected eaves regions E1, E2 is defined by the intersection EC of the roof deck R and ceiling base C and the distance to a first or initial firefighting fluid distribution device 110 disposed medially of the intersection EC between the intersection EC and the peak P. The location of this first or initial fluid distribution device 110 relative to the intersection EC defines (i) a vertical distance VD of the fluid distribution device 110 to the ceiling base C; (ii) a vertical length of the preferred eaves regions E1, E2; and (iii) a horizontal span HS of the preferred eaves region E1, E2 along the ceiling deck. The location of the first or initial medially located distribution device 110 relative to the intersection of the roof and ceiling joists can also define the hypotenuse H of the preferred eaves regions E1, E2 in the direction of the sloping roof deck R. Moreover, the fluid distribution devices 110 are preferably disposed in the attic space 10 between the roof deck R and the ceiling base C so as to define a peak region PR above the fluid distribution devices 110. As described herein, the fluid discharge from the fluid distribution devices 110 is controlled or initiated by separately located fire detection assemblies 130 spaced above the fluid distribution devices 110 in the peak region PR of the attic space 10 preferably proximate the peak P.

The preferred fire protection systems and methods described herein can provide for a size of protected eaves region as previously known in which the first or initially medially disposed distribution device 110 is installed at a vertical distance VD ranging from twenty-four inches to twenty-nine inches. Additionally or alternatively, by employing spaced fire detection assemblies 130 to control or initiate fluid discharge from the distribution devices 110, the preferred systems and methods of attic protection can provide for protected eaves regions E larger than previously known with fluid distribution device 110 located at a medial distance from the intersection EC that is greater than any previously commercially known system. The initial medially located fluid distribution device 110 protecting the eaves region E is preferably located at a vertical distance VD from the ceiling base C that is greater than previously known while providing adequate fluid density to protect the eaves regions E1, E2 to effectively address, control, suppress, or extinguish a fire and/or prevent significant burn through of the ceiling base C. For example, the first or initially medially disposed distribution device 110 is at a preferred vertical distance VD from the ceiling base C to define a working clearance distance that is preferably about thirty inches or greater. More preferably, the vertical distance VD defines a working clearance distance beneath the fluid distribution device(s) 110 which provides for an area that is clear for an installer, contractor, operator or other personnel to comfortably operate within the attic space 10 to install the system or perform any other function. The vertical distance VD can define a preferred working clearance distance between the fluid distribution device 110 and the ceiling base C that is unconstrained and can be increased at six inch increments over three feet up to a working clearance distance of six feet or more, such that a fluid distribution device 110 can be selected and installed at a vertical distance VD being any one of, for example: thirty-six inches; forty-two inches; forty-eight inches, fifty-two inches; sixty inches; sixty-six inches or seventy-two inches. Thus, the preferred systems and methods herein can provide extended protection eaves regions E1, E2 with the fluid distribution device 110 installed at higher vertical distances VD above the ceiling base C than previously known.

The preferred systems and methods provide for the desired fire protection of the attic space 10 by providing for fire detection in a location that is separately spaced from the location of firefighting agent distribution. By preferably locating the fire detection components or assemblies 130 in the peak region PR, and more preferably proximate the peak P, of the attic space 10 spaced from the fluid distribution devices 110, the fluid distribution devices 110 can be installed about the attic space without regard to the function of fire detection. Thus, to the extent the preferred embodiments of the fluid distribution devices 110 described herein include a thermally responsive trigger, such as for example automatic sprinklers, the separate fire detection assemblies 130 can provide for a preferred installation in which the fluid distribution devices 110 are installed independent of their thermal responsiveness. Accordingly, a group of fluid distribution devices 110 can protect larger eaves regions E than previously known, preferably an expanded or extended protected eaves region E, by locating the distribution devices 110 at vertical heights VD and horizontal distances HS from the intersection EC that are greater than previously known. Thus, the preferred systems do not require installation of detectors or fluid distribution devices within the low clearance areas of the attic space in which access may be difficult in order to provide desired eaves protection.

Referring again to FIG. 1A, one preferred embodiment of the system 100 includes a plurality of fluid distribution devices 110 and one or more separate fire detection assemblies 130 for detecting a fire from the peak region PR and generating a detection signal for controlled operation of one or more of the fluid distribution devices 110. Accordingly, the detection assembly(ies) 130 and distribution devices are associated with one another to provide for the desired system response. Preferred embodiments of the system can further include a centralized controller 120 for communication with each of the distribution devices 110 and detectors 130. The fluid distribution devices 110 are coupled directly or indirectly with the controller 120 for selective operation at a preferred time following fire detection by the detector(s) 130 to provide a volumetric flow of fluid or distribution density, such as for example 0.1 gpm/sq. ft., to effectively address a fire in the attic space.

The detection assemblies 130 are preferably located in the peak region proximate the peak P to provide for fire detection throughout the attic space 10. Moreover, the fire detection assemblies 130 preferably include passive temperature sensors or elements to detect fires passively so as not to directly detect or measure the heat or temperature of a fire, but instead indirectly detect a fire by, for example infrared radiation or other byproduct of a fire. Preferred embodiments of the detection assembly 130 can include passive infrared sensors, ultrasonic detectors, microwave sensors or a combination thereof. An infrared detector can monitor the attic space 10 to detect changes in the thermal energy or spectral energy of the space that indicates a fire. Alternatively or additionally, the preferred detection assembly 130 can include an ultrasonic emitter and receiver and/or microwave monitor emitter and receiver to monitor the attic space and detect products of combustion that represent a fire. By combining infrared, ultrasonic and/or microwave monitoring to detect a fire, the preferred detector 130 can provide a redundancy in detection to minimize or eliminate an erroneous fire detection. Alternatively, the detection assemblies 130 can include active sensors or elements for detecting a fire, in which the sensors directly detect, or measure, the temperature or heat of the fire. Such active sensors can include thermocouples or other thermally sensitive elements.

Each of the preferred detection assemblies 130 defines a preferred field of view and coverage area based at least in part upon its mounting. For example, the infrared sensors are preferably mounted to maximize their field of view to monitor the attic space by avoiding or minimizing obstructions. The ultrasonic and/or microwave sensors can be mounted preferably without necessarily considering obstructions as the ultrasound and/or microwaves can pass through solid objects. Accordingly, the number of ultrasonic or microwave components can be minimized without needing to increase the number of detection components to space about and overcome the obstruction. Moreover, where the infrared detectors, ultrasound and/or microwave sensors are integrated into a single detection assembly 130, the ultrasonic or microwave sensors can minimize the number of detectors 130 without needing to increase the number of detectors to space about and overcome an obstruction. Exemplary infrared and infrared/ultrasonic detectors and monitors for use in the system 100 are described in Leviton, Technical Bulletin: PIR and US Sensor Technology (Mar. 17, 2010). A preferred detection assembly 130 can be embodied by or include an ultrasonic-microwave Doppler sensor which is described in an article entitled, "Fire Detection With A Combined Ultrasonic-Microwave Doppler Sensor" (October 1998).

To maximize the field of view of the detection assembly 130 and/or more efficiently physically associate the detection assemblies 130 with the fluid distribution devices 110, the fire detection assemblies 130 are preferably located in the peak region PR above the fluid distribution devices 110 of the system 100. Referring to FIGS. 1A and 1C, the roof deck R can include a first end and a second end to define a peak ridge or line at its peak P that extends linearly from end to end as shown in FIG. 1A. The detection assemblies 130 are more preferably proximate the peak P and more preferably aligned along a peak ridge or line so as to sense a fire throughout the attic space 10 including along the ceiling base C and within the eaves region E. In another preferred aspect, each of the detectors or detection assemblies 130 can be mounted to monitor specific portions or regions of the attic space. In such a preferred system, the detectors 130 alone or in combination with the controller 120 actuate or control the discharge from fluid distribution devices 110 positioned to discharge into the region in which a fire is detected. Additionally or alternatively, the detectors 130 can also be mounted or configured relative to the distribution devices 110 so as to associate each detector 130 with one or more of the devices 110. Thus upon a detection of a fire by a detector 130, the detector 130 or controller 120 actuates the one or more devices 110 associated with the detector 130.

Figure 3A:
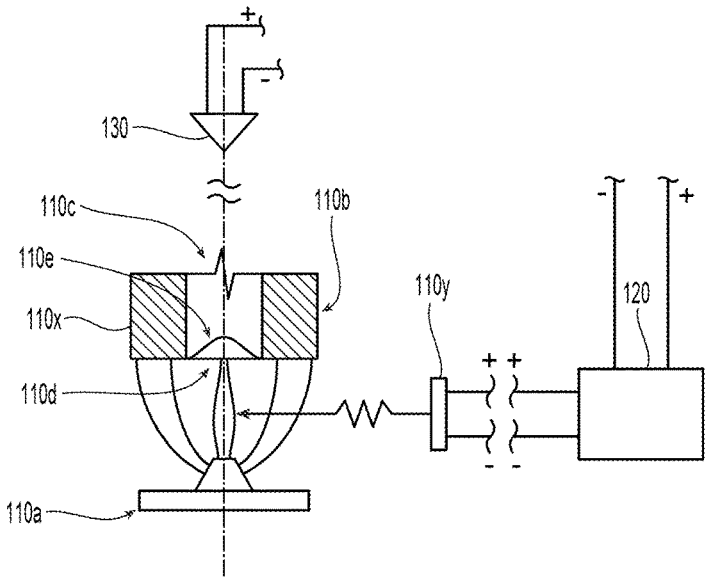
FIGS. 3A-3B are schematic views of preferred embodiments of a fluid distribution and controller arrangement for respective use in the systems of FIGS. 1A and 2A.
Figure 3B:
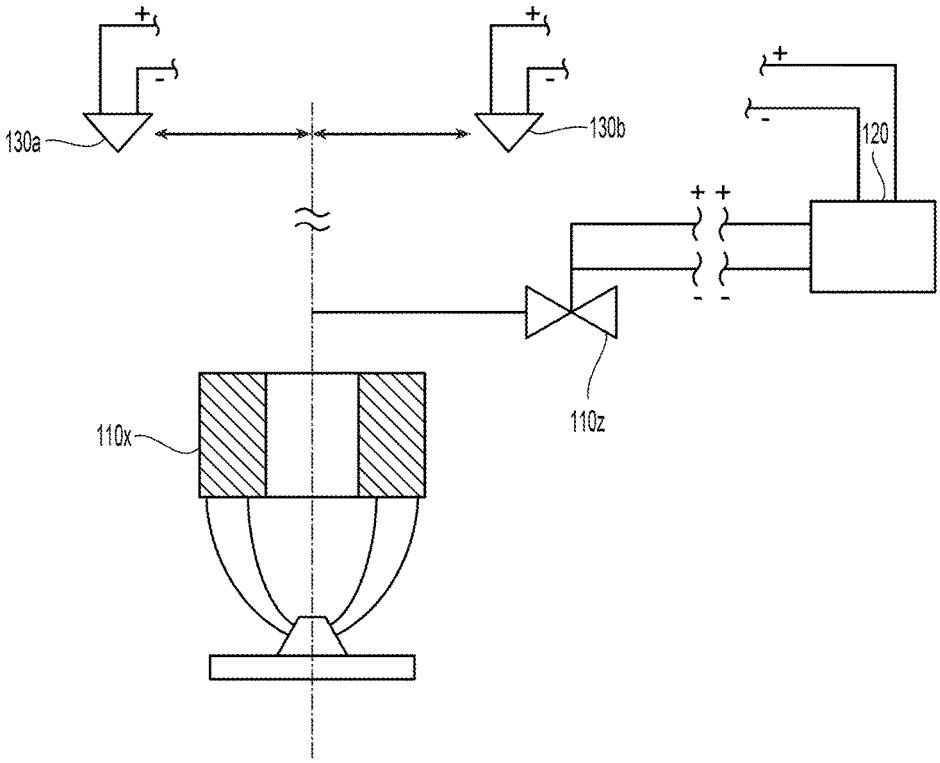

Preferred embodiments of the firefighting distribution devices 110 can include fire protection sprinklers as understood in the art and appropriately configured for controlled actuation as described herein. Generally as schematically shown in FIGS. 3A and 3B, a fire protection sprinkler 110*x* includes a fluid deflecting member 110*a* coupled to a frame body 110*b*. The frame body includes an inlet 110*c* for connection to the piping network and an outlet 110*d* with an internal passageway extending between the inlet and the outlet. The deflecting member or deflector 110*a* is axially spaced from the outlet 110*d* and can be oriented to define any one of an upright, pendent or sidewall sprinkler orientation. Water or other firefighting fluid is delivered to the inlet at an operating pressure of the sprinkler to generate a volumetric flow of fluid to effectively address a fire in a manner as described herein. The fire protection sprinkler can include a sealing assembly 110*e* or other internal valve structure disposed and supported within the outlet to occlude and control the discharge from the device 110*x*. The water is discharged from the outlet 110*d* to impact the deflecting member 110*a*; and the deflecting member distributes the firefighting fluid to deliver a volumetric flow which contributes to the preferred collective volumetric flow to sufficiently address the fire. Sprinklers for use as a fluid distribution device 110 in the preferred systems and methods include the TYCO PEAK PERFORMANCE MODEL BB™ (Back to Back), SD™ (Single Directional), HIP™ and AP™ (Attic Plus) "Specific Application Sprinklers for Protecting Attics," as shown and described in Tyco Fire Products LP Publication, "Application: The Use of Specific Application Sprinklers for Protecting Attics" (2007). Alternate embodiments of the firefighting distribution devices 110 for use in the system 100 include nozzles, misting devices or any other devices configured for controlled operation to distribute a volumetric flow of firefighting fluid in a manner described herein, such as for example, fire grenades or fire aerosols.

As shown in FIG. 1A, the firefighting fluid distribution devices 110 are installed and coupled to supply piping or lines of a firefighting fluid and source SRC. The distribution devices 110 can be installed along branch piping that extends parallel to the peak ridge or alternatively the branch piping can extend perpendicular to the peak ridge. The devices 110 are selected and installed to define discharge characteristics and patterns that can provide adequate coverage or density to protect the eaves region when positioned in the preferred installation between the peak P and eaves region E as shown in FIG. 1B. Because the detection assemblies 130 are spaced and located independent from the fluid distribution devices 110, the distribution devices 110 can be installed and spaced in any manner provided the installation provides for the desired fluid distribution pattern or density, for example 0.1 gpm/sq. ft., upon system actuation. Thus, for the preferred system installation, the distribution devices 110 and associated piping are disposed in a conveniently accessible area of the attic space to define the preferred first and second protected eaves regions and more preferably extended protected eaves regions E1, E2 with the distribution devices 110 first or initially disposed medially of the intersections EC at a vertical distance VD from the ceiling base C to define a preferred working clearance distance. For a preferred installation, the vertical and preferred working clearance distance is preferably 30 inches or greater. Even more preferably, the working clearance distance of the eaves protecting fluid distribution device 110 to the ceiling base C can be increased at six inch increments over two feet, for example, from three feet up to six feet or more, such that a fluid distribution device 110 can be selected and installed at a vertical distance VD being any one of, for example: thirty-six inches; forty-two inches; forty-eight inches, fifty-two inches; sixty inches; sixty-six inches; seventy-two inches or greater, provided the fluid distribution device 110 can provide a fluid distribution density to protect the eaves region. Accordingly, for preferred embodiments of the systems described herein, the fire detection assemblies 130 are located in a peak region PR above the fluid distribution devices 110 and more preferably proximate the peak P within a preferred radius RAD of the peak P of two feet (2 ft.). However, it should be understood that the fire detection assemblies 130 can be located at any radial distance proximate the peak P within the peak region PR provided the detection assembly 130 can detect a fire in an area of the attic space in a manner as described herein.

The distribution devices 110 of the system 100 are preferably individually addressable for actuation by an appropriate signal directly from the detection assembly 130 or indirectly from the controller 120. Shown in FIGS. 3A and 3B are schematic representations of preferred electro-mechanical coupling arrangements between a preferred firefighting distribution device 110 and the controller 120, which can alternatively be a detection assembly 130. Shown in FIG. 3A is a sprinkler 110*x* having an internal sealing assembly supported in place by a removable structure, such as for example, a thermally responsive glass bulb trigger. A preferably electrically operated actuator 110*y* is arranged, coupled, or assembled, internally or externally, with the sprinkler 110*x* for displacing the support structure by fracturing, rupturing, ejecting, and/or otherwise removing the support structure and its support of the sealing assembly to permit fluid discharge from the sprinkler. The actuator 110*y* is preferably electrically coupled to the controller 120 so that the controller provides, directly or indirectly, an electrical pulse or signal for signaled operation of the actuator to displace the support structure and the sealing assembly for controlled discharge of firefighting fluid from the sprinkler 110*x*.

Alternate or equivalent distribution device electro-mechanical arrangements for use in the system are shown in U.S. Pat. Nos. 3,811,511; 3,834,463 or 4,217,959. Shown and described in FIG. 2 of U.S. Pat. No. 3,811,511 is a sprinkler and electrically responsive explosive actuator arrangement in which a detonator is electrically operated to displace a slidable plunger to rupture a bulb supporting a valve closure in the sprinkler head. Shown and described in FIG. 1 of U.S. Pat. No. 3,834,463 is a sprinkler having an outlet orifice with a rupture disc valve upstream of the orifice. An electrically responsive explosive squib is provided with electrically conductive wires that can be coupled to the controller 120. Upon receipt of an appropriate signal, the squib explodes to generate an expanding gas to the rupture disc to open the sprinkler. Shown and described in FIG. 2 of U.S. Pat. No. 4,217,959 is an electrically controlled fluid dispenser for a fire extinguishing system in which the dispenser includes a valve disc supported by a frangible safety device to close the outlet orifice of the dispenser. A striking mechanism having an electrical lead is supported against the frangible safety device. The patent describes that an electrical pulse can be sent through the lead to release the striking mechanism and fracture the safety device thereby removing support for the valve disc to permit extinguishment fluid to flow from the dispenser.

In a preferred operation of the preferred system 100, the preferred detection assemblies 130 monitor the attic space 10, and the monitoring data is communicated from the detection assemblies 130 to the controller 120. Upon detection of a fire, the controller 120 actuates or controls fluid discharge from the distribution devices 110 in response to the detected fire. More preferably, the controller 120 selectively determines which distribution devices 110 to operate in response to the detected fire in order to effectively address the fire and minimize the number of actuated devices to minimize overall hydraulic demand on the system. The detection assemblies 130 are preferably installed with a sensor sensitivity to detect any fire within the attic space at the initial or incipient stages of the fire. Accordingly, the preferred detection assemblies 130 include passive elements as previously described to detect a fire. It is believed that the use of passive elements can avoid a detection lag in fire detection assemblies using active elements or sensors, such as for example, thermally sensitive bulbs or links due to heat absorption by the surrounding components of such assemblies, e.g., the glass bulb. The preferred controller 120 responds accordingly to the detection signals to actuate the distribution devices 110 to address the fire preferably in its incipient stages.

Figure 4:
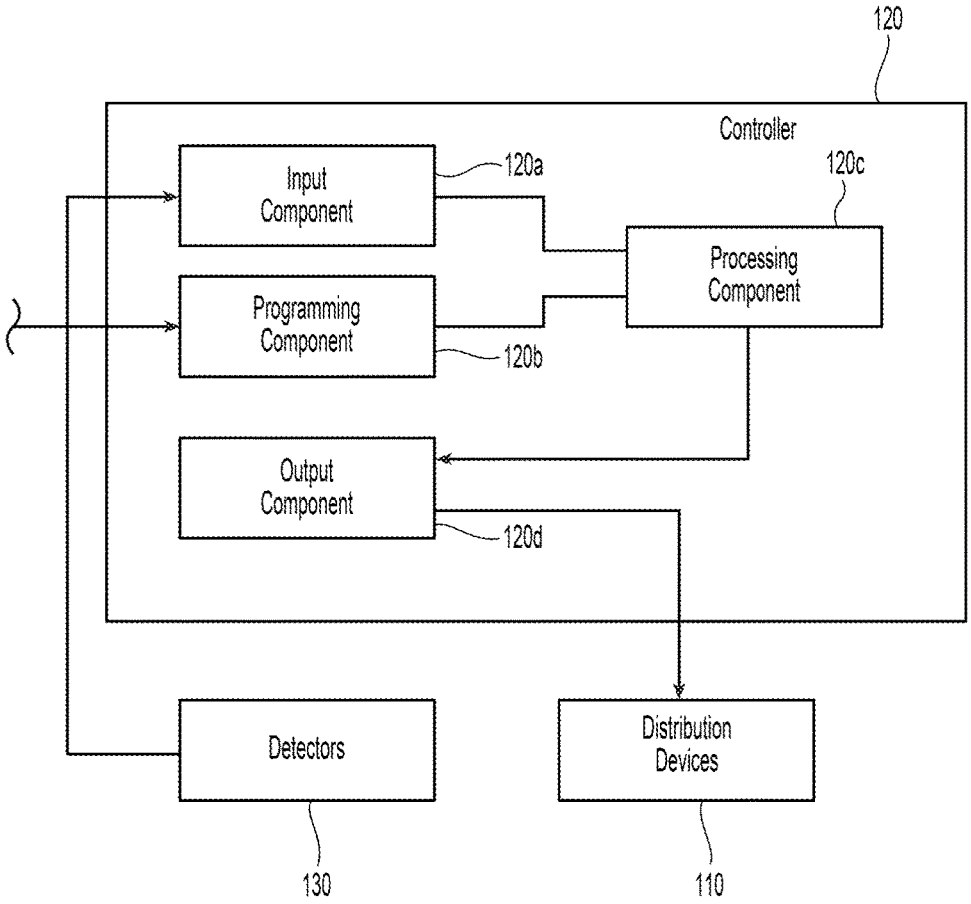
FIG. 4 is a schematic view of a preferred controller for use in the systems of FIGS. 1A and 2A.

A preferred centralized controller 120 is shown schematically in FIG. 4 for receiving, processing and generating the various input and output signals from and/or to each of the detection assemblies 130 and distribution devices 110. The communication between components of the system 100 can be any one or more of wired or wireless communication. Functionally, the preferred controller 120 preferably includes a data input component 120*a*, a programming component 120*b*, a processing component 120*c* and an output component 120*d*. The data input component 120*a* receives detection data or signals from the one or more detection assemblies 130. Additional data parameters collected from the detection assemblies 130 can include time data, address or location data of the detection assembly 130. The preferred programming component 120*b* provides for user-defined operational parameters of the system to measure and analyze a fire including, for example, its location and magnitude of its threat. The programming may be hard wired or logically programmed and the signals between system components can be one or more of analog, digital, or fiber optic data. With a fire detected and located, the preferred processing controller 120*c* and output component 120*d* of the controller 120 further preferably generate appropriate signals for the controlled operation of the distribution devices 110 through the preferably electrically operated actuator.

Figure 2A:
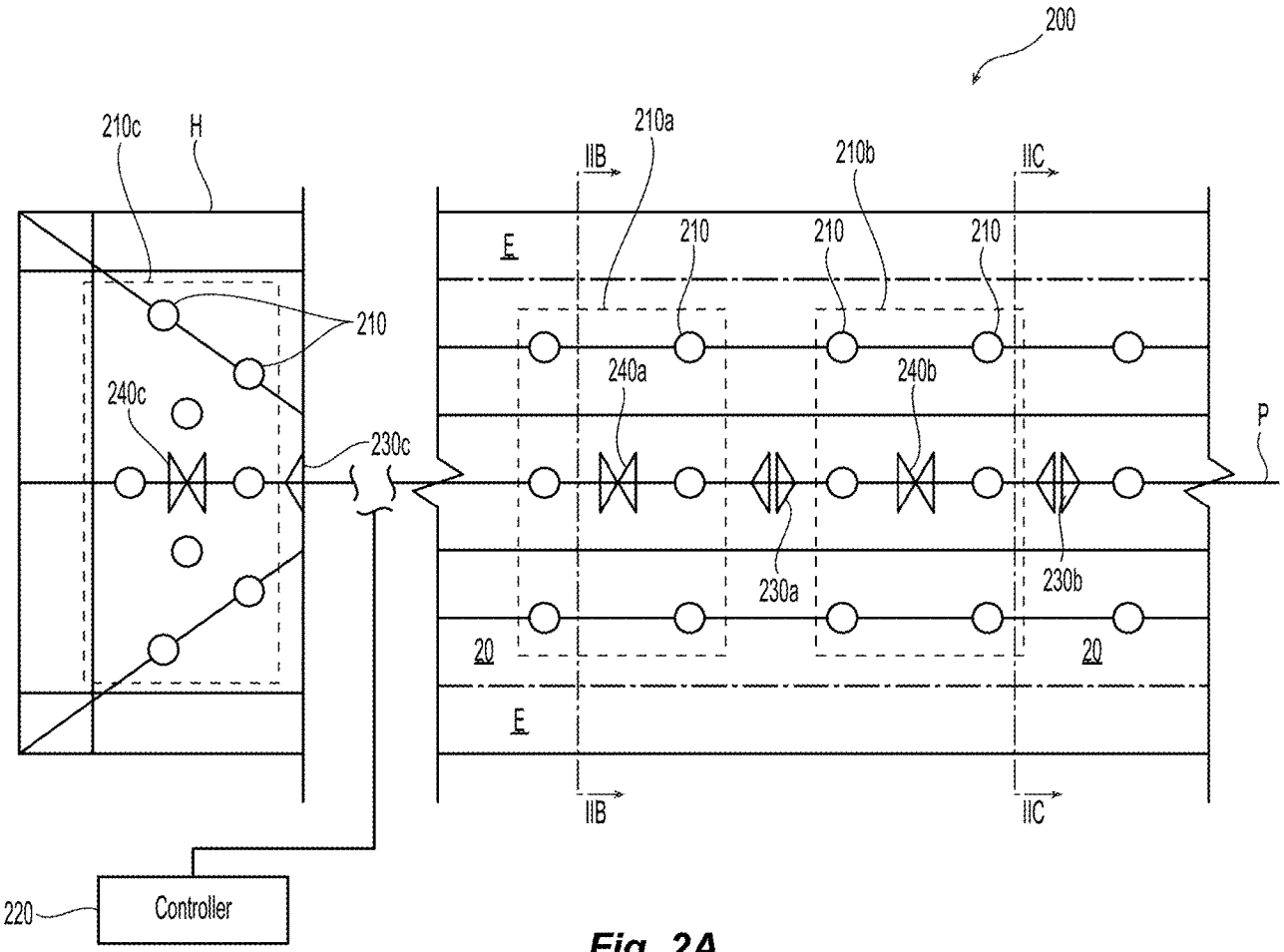
FIG. 2A shows a plan schematic view of a preferred controlled dry system.
Figure 2B:
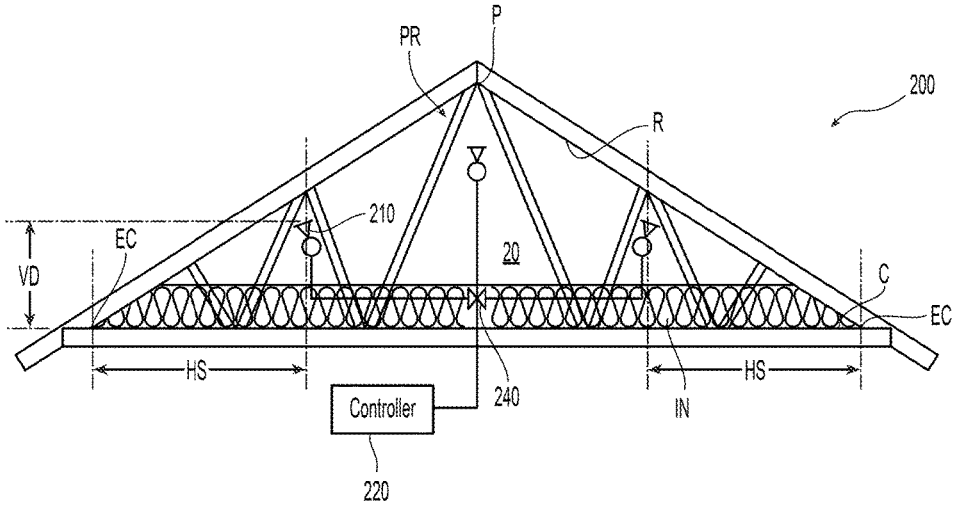
FIG. 2B shows a schematic view of the system of FIG. 2A along line IIB-IIB.
Figure 2C:
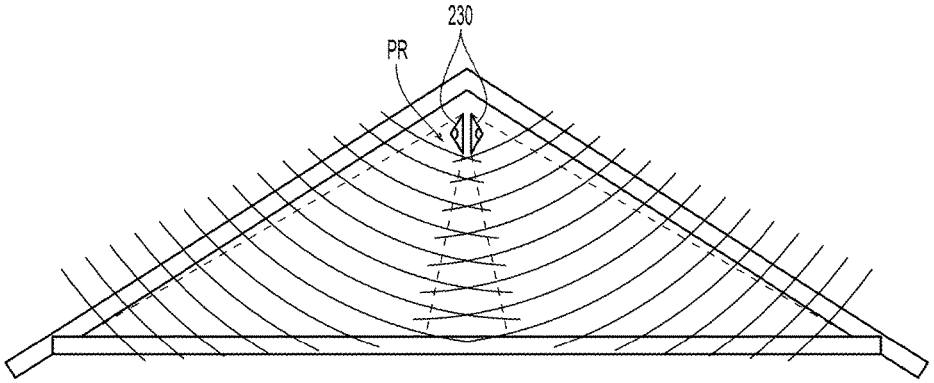
FIG. 2C shows a schematic view of the system of FIG. 2A along line IIC-IIC.

The previously described embodiments of the system shown in FIGS. 1A and 1B are wet systems in which the firefighting agent is delivered to the inlet of the unactuated distribution device 110 under pressure. Shown in FIGS. 2A-2C is a preferred dry-type sprinkler system 200 for the protection of the attic space 20. The attic space 20 can be defined by a sloped roof deck R and a ceiling base C in a manner as previously described. The attic space 20 further includes an insulated region IN which insulates the occupancy below the ceiling base C from the upper portion of the attic space 20 which may be subject to temperatures below freezing.

As with the previously described system, the dry-type system 200 preferably includes a plurality of firefighting agent distribution devices 210, one or more detection assemblies or detectors 230 and a centralized controller 220 for preferably operatively coupling between the detectors 230 and distribution devices 210. The detectors 230 are preferably located and spaced in the peak region and more preferably proximate the peak P of the attic space as schematically shown in FIG. 2C. However, instead of the firefighting agent or fluid being delivered under pressure to unactuated distribution devices, the delivery of the firefighting fluid to the distribution devices 210 is controlled by one or more fluid control valves 240. Moreover, the distribution devices 210 are preferably in an open state or without any internal sealing assembly, for example a normally open fire protection sprinkler, such that the preferred dry-type system 200 is configured as a deluge-type system with a plurality of normally open sprinklers 210. The preferably open fluid distribution devices 210 can be located above the ceiling base C to define a preferred vertical distance VD and working clearing distance as previously described.

The fluid control valve 240 is maintained in a closed state in an unactuated state of the system 200 so that the piping between the valve 240 and the distribution devices 210 is empty or "dry." The control valve 240 is coupled to the controller 220 for controlled actuation in response to a detection signal from the detection assembly 230 indicating a fire. An exemplary fluid control valve for use in the system is shown in Tyco Fire Protection Products publication, "Series MJC Multiple Jet Controls DN20, DN25, DN40 and DN50, 12 bar BSPT Inlet & Outlet Threads" (May 2013). As described therein, the preferred valve includes a thermally responsive trigger or valve. The trigger can be modified with an electrically responsive actuator and coupled to the controller 220, or alternatively coupled directly to the detection assembly(ies) 230 to provide for controlled electronic operation of the valves 240 for fluid delivery to the open distribution devices 210. The electrically responsive actuator can be similar to the actuators previously shown and described with respect to FIG. 3A. Shown in FIG. 3B is another preferred electro-mechanical arrangement for controlled actuation that includes an electrically operated solenoid valve 110*z* coupled to an open sprinkler 110*x* to control the discharge from the distribution device. With no seal assembly in the sprinkler outlet, water or other firefighting agent is permitted to flow from the open sprinkler 110*x* upon the solenoid valve 110*z* receiving an appropriately configured electrical signal from the controller 120 to open the solenoid valve depending upon whether the solenoid valve is normally closed or normally open. Exemplary known electrically operated solenoid valves for use in the system 200 can include the electric 2/2 Series 8210 Pilot Operated General Service Solenoid Valves from ASCO® and equivalents thereof. In yet another embodiment of the system 200, the controller can be coupled to an adjustable fluid control valve to operate the valve and control the volume or flow rate to the distribution devices, such as for example, the servo valves shown in the white paper by Dan Baran and entitled, "Design of Long Life Servo Valves Moog's Approach to Design, Manufacture, and Construction of Feedback Mechanisms" (2012).

With reference to FIG. 2A, the distribution devices 210 are preferably installed and located about the attic space in a manner as previously described; and, in particular, at a vertical distance VD to provide the preferred working clearance distance and extended protected eaves regions as previously described. The preferred system 200 includes multiple fluid control valves 240*a*, 240*b*, 240*c* to provide controlled fire protection to defined regions of the attic space. For example, groups of distribution devices 210*a*, 210*b*, 210*c* are respectively coupled to the three fluid control valves 240*a*, 240*b*, 240*c* to define the desired fire protection to a region of the attic space. Referring to FIG. 2B, the fluid control valves 240*a*, 240*b*, 240*c* are preferably coupled to the controller 220 for selective controlled operation of the valves. The actuator of each fluid control valve 240 is preferably individually addressable by the controller 220 for the selective control. As shown, the fluid control valve 240 is preferably located proximate to the ceiling base C within the insulated region IN to insulate the valve from the colder attic region.

In operation of the preferred system 200, the preferred detection assemblies 230 monitor the attic space 20. The monitoring data is communicated from the detectors 230 to the controller 220. Upon detection of a fire, the controller 220 selectively operates the fluid control valve 240 to deliver the firefighting agent to the preferably open distribution devices 210. The fluid distribution devices 210 wet the region of the attic space including the portion of the roof deck R, ceiling base C and eaves region E in the region in which the fire was detected.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A fire protection system for the protection of an attic space having a ceiling base and a roof deck disposed above and sloped with respect to the ceiling base to define a peak, the system comprising:

a plurality of fluid distribution devices disposed in the attic space to define a peak region;

at least one fire detection assembly disposed in the peak region spaced above each of the plurality of fluid distribution devices, wherein the attic space includes an eaves region defined by an intersection of the roof deck and ceiling base and exclusive of the plurality of fluid distribution devices, and the plurality of fluid distribution devices includes at least one fluid distribution device disposed medially of the eaves region to define a vertical distance to the ceiling base of thirty inches or greater, wherein each of the plurality of fluid distribution devices is associated with the at least one fire detection assembly to initiate fluid discharge from the plurality of fluid distribution devices in response to the at least one fire detection assembly generating a detection signal.

2. The system of claim 1, wherein the plurality of fluid distribution devices are associated with the at least one fire detection assembly by a controller coupling the at least one fire detection assembly to each of the plurality of fluid distribution devices to actuate each of the plurality of distribution devices in response to the at least one fire detection assembly generating a detection signal.

3. The system of claim 2, wherein the controller processes a fire detection signal from the detection assembly to operate an actuator to actuate at least one fluid distribution device.

4. The system of claim 1, wherein the vertical distance is thirty inches or greater and defines an extended protected eaves region.

5. The system of claim 4, wherein the vertical distance defines a working clearance beneath the fluid distribution device ranging from thirty-six to seventy-two inches.

6. The system of claim 1, wherein the fire detection assembly is passive, including at least one of: an infrared sensor, an ultrasonic sensor, a microwave sensor or a combination thereof.

7. The system of claim 1, wherein the plurality of fluid distribution devices includes any one of a sprinkler, a nozzle, a misting device, or a combination thereof.

8. The system of claim 7, wherein the plurality of fluid distribution devices comprises a plurality of fire protection sprinklers being any one of upright, pendent or sidewall sprinklers.

9. The system of claim 1, wherein the plurality of fluid distribution devices comprises normally open fire protection sprinklers, associated with the at least one fire detection assembly by at least one fluid control valve coupled to a group of the open sprinklers;

a controller; and an actuator coupled to the controller for opening the at least one fluid control valve in response to a fire detection signal by the at least one detection assembly.

10. The system of claim 1, wherein the plurality of fluid distribution devices includes a fire protection sprinkler including a frame defining an internal passageway, a fluid deflector member to deflect fluid flowing from the internal passageway and a seal assembly to occlude flow from the passageway in an unactuated state of the sprinkler, the system including:

an actuator for displacing the seal assembly in response to a fire detection signal from the at least one detection assembly.

11. A method of providing fire protection of an attic space defined by a ceiling base, a roof deck disposed above the ceiling base, the roof deck being sloped with respect to the ceiling base to define a peak, the method comprising:

locating a plurality of fluid distribution devices below the peak and thirty inches or greater above the ceiling base to define a peak region and a protected eaves region;

locating a fire detection assembly in the peak region spaced above each of the plurality of fluid distribution devices, the protected eaves region being defined by an intersection of the roof deck and ceiling base and exclusive of the plurality of fluid distribution devices; and associating each of the plurality of fluid distribution devices with the fire detection assembly to initiate fluid discharge from the plurality of fluid distribution devices in response to the fire detection assembly generating a detection signal.

12. The method of claim 11, wherein the associating includes coupling the fire detection assembly to the plurality of fluid distribution devices with a controller, the method further comprising detecting a fire in the protected eaves region and signaling the controller with the fire detection assembly to discharge fluid from the fluid distribution devices.

13. The method of claim 11, wherein locating the plurality of fluid distribution devices defines an extended protected eaves region including locating the plurality of fluid distribution devices at a vertical distance above the ceiling base ranging from thirty-six to sixty inches.

14. The method of claim 11, wherein the associating includes controlling operation of a fluid control valve coupled to the plurality of fluid distribution devices, the plurality of fluid distribution devices being normally open fire protection sprinklers.

15. An attic space fire protection system comprising:

at least one fluid distribution device defining an extended protected eaves region;

the extended protected eaves region also defined by an intersection of a roof deck and a ceiling base and exclusive of the at least one fluid distribution device;

wherein the at least one fluid distribution device defines a working clearance of over thirty inches; and a fire detection assembly in a peak region of the attic disposed above and associated with the at least one fluid distribution device to initiate fluid discharge from the at least one fluid distribution device in response to the fire detection assembly generating a detection signal.

16. The system of claim 15, wherein the working clearance distance ranges from thirty-six inches to sixty inches.

17. The system of claim 15, further comprising a controller associating the fire detection assembly and the at least one fluid distribution device.

18. The system of claim 17, further comprising a fluid control valve coupled to the controller for releasing fluid to the at least one fluid distribution device.

19. The system of claim 15, wherein the fire detection assembly is located proximate a peak of the attic space.

20. The system of claim 15, wherein the fire detection assembly includes a passive sensor.

* * * * *